United States Patent [19]

Knapp

[11] Patent Number: 5,012,287

[45] Date of Patent: Apr. 30, 1991

[54] COMPACT TWO-COMPONENT DEVELOPMENT SYSTEM WITH ZONAL TONER DISPENSER CONTROL

[75] Inventor: John F. Knapp, Fairport, N.Y.

[73] Assignee: Xerox Corporation, Stamford, Conn.

[21] Appl. No.: 484,297

[22] Filed: Feb. 26, 1990

[51] Int. Cl.[5] ..... G03G 15/09

[52] U.S. Cl. ..... 355/253; 118/651; 118/653; 355/259

[58] Field of Search ..... 355/261-265, 355/246, 251, 214, 259, 253; 118/661, 651, 648-650, 657, 658, 653

[56] References Cited

U.S. PATENT DOCUMENTS 4,766,468 8/1988 Hosono et al. ..... 355/261 X

FOREIGN PATENT DOCUMENTS 0111568 7/1982 Japan ..... 355/253

0241069 11/1985 Japan ..... 355/259

*Primary Examiner*—A. T. Grimley

*Assistant Examiner*—William J. Royer

[57] ABSTRACT

Developer apparatus and toner dispenser system therefor that is capable of modulating toner addition very uniformly, not only across the width of a developer housing but selectively along a length of a developer member in an area that was previously depleted by its passage through a development nip. Thus, toner is dispensed only where it is needed.

18 Claims, 3 Drawing Sheets

COMPACT TWO-COMPONENT DEVELOPMENT SYSTEM WITH ZONAL TONER DISPENSER CONTROL

BACKGROUND OF THE INVENTION

This invention relates generally to copying or printing apparatus, and more particularly, it relates to the dispensing of particulate toner material in a two-component development system.

In an electrophotographic copying and/or printing machine, a charge retentive surface such as a photoconductive member is charged to a substantially uniform potential to sensitize the surface thereof. The charged portion of the photoconductive member is exposed to light patterns representative of an image being reproduced. Exposure of the charged photoconductive member selectively to light dissipates the charge thereon in the irradiated areas. This records an electrostatic latent image on the photoconductive member corresponding to the desired information. After the electrostatic latent image is recorded on the photoconductive member, it is developed by bringing a developer material into contact therewith. This forms a powder image on the photoconductive member which is subsequently transferred to a copy sheet. The powder images on the sheet are heated to permanently affix the marking particles thereto in image configuration.

In the foregoing type of printing machine, a development housing is employed to deposit toner material onto the electrostatic latent image recorded on the photoconductive surface. The latent image may be developed with a two component developer. In a two-component developer, fine toner particles adhere triboelectrically to coarser carrier granules. Typically, the toner particles are made from a thermoplastic material while the carrier granules are made from a ferromagnetic material.

All two component development housings require continuous replenishment of toner to a developer sump as prints are made. Toner addition is the dominant control mechanism for most xerographic machines. Usually a print quality sensor like an IRD looking at developed patches on a photoreceptor, or a toner concentration sensor like a permeability or conductivity control device, are used to turn a toner dispenser on or off. Toner dispenser design is critical to the maintenance of xerographic print quality.

Toner addition is often achieved by attempting to uniformly disperse the toner across the width of the development housing. This is often done by devices like a foam roll, a brush and screen, a thumper or shaker design. In practice, these usually do not produce uniform dispensing of the toner. Often it is dispersed in clumps across the width of the housing. Toner addition is also often achieved by adding it at one end of an auger that also captures some quantity of circulating sump developer. All these dispensers attempt to keep toner concentration under control by adding toner in bursts. After toner is dispensed to the developer in this manner additional hardware is always required to uniformly blend the added toner. This is often achieved with complex passive cross mixing baffles, coned fins on paddle wheels or multiple auger arrangements.

BRIEF SUMMARY OF THE INVENTION

The present invention relates to a developer apparatus and toner dispenser system that is capable of modulating toner addition very uniformly, not only across the width of a developer housing but selectively along a length of a developer member in an area that was previously depleted by its passage through a development nip. Thus, toner is dispensed only where it is needed, thereby eliminating sub-system parts required to provide cross mixing and toner dispersion.

In my invention, latent electrostatic images contained on a moving charge retentive surface such as a photoreceptor are developed by a two component magnetic brush development unit. Typically in a magnetic brush development unit a roll structure with fixed magnets is provided. Fixed magnets inside of the roll or shell enable transport of developer material through the photoreceptor nip into a toner dispenser nip.

In the development housing, a toner particle transport in the form of a "holey" tube moves toner from a remote sump and loads it as needed in a thin layer onto a toner delivery roller. This toner delivery roller supplies the toner to the depleted two component developer.

As depleted developer passes through a nip formed between the magnetic roll and a donor roll toner from the donor can be selectively scavenged from the donor roll and swept into the developer stream. The amount of toner pulled off the donor roll can be controlled by the speed of the donor roll and the electrostatic field between the donor and magnetic brush shell.

The donor roll is divided into a number of electrically segmented pieces along the length of the development housing. By selectively biasing or varying the bias on a segment of the donor roll, the amount of toner added to developer at discrete positions from inboard to outboard side of housing can be effected as needed. By adding toner only at positions where it gets depleted no massive cross-mixing devices are required.

Information as to what voltage to apply to each donor segment may be provided from a knowledge of the input document or the electrostatic image on the photoreceptor. In a printer or electronic reprographic machine detailed pixel by pixel knowledge is always available. At what time to apply it and how long to keep it on comes from knowing the magnetic roll/-photoreceptor speed ratio, the time constant between development nip and donor nip, and how many segments to break things up into. The characteristics of the captive magnetic brush enables provides these constants. Alternatively, the developer conductivity or permeability in segments across the housing may be monitored to provide signals for controlling the quantity of toner transferred form the donor roll segments.

Being able to vary the rotational speed of the donor roll provides for increased toner addition for those occasional high area inputs that require rapid toner addition.

DESCRIPTION OF THE DRAWINGS

Other aspects of the present invention will become apparent as the following description proceeds and upon reference to the drawings, in which.

DETAILED DESCRIPTION OF THE PREFERRED EMBODIMENT OF THE INVENTION

Figure 1:
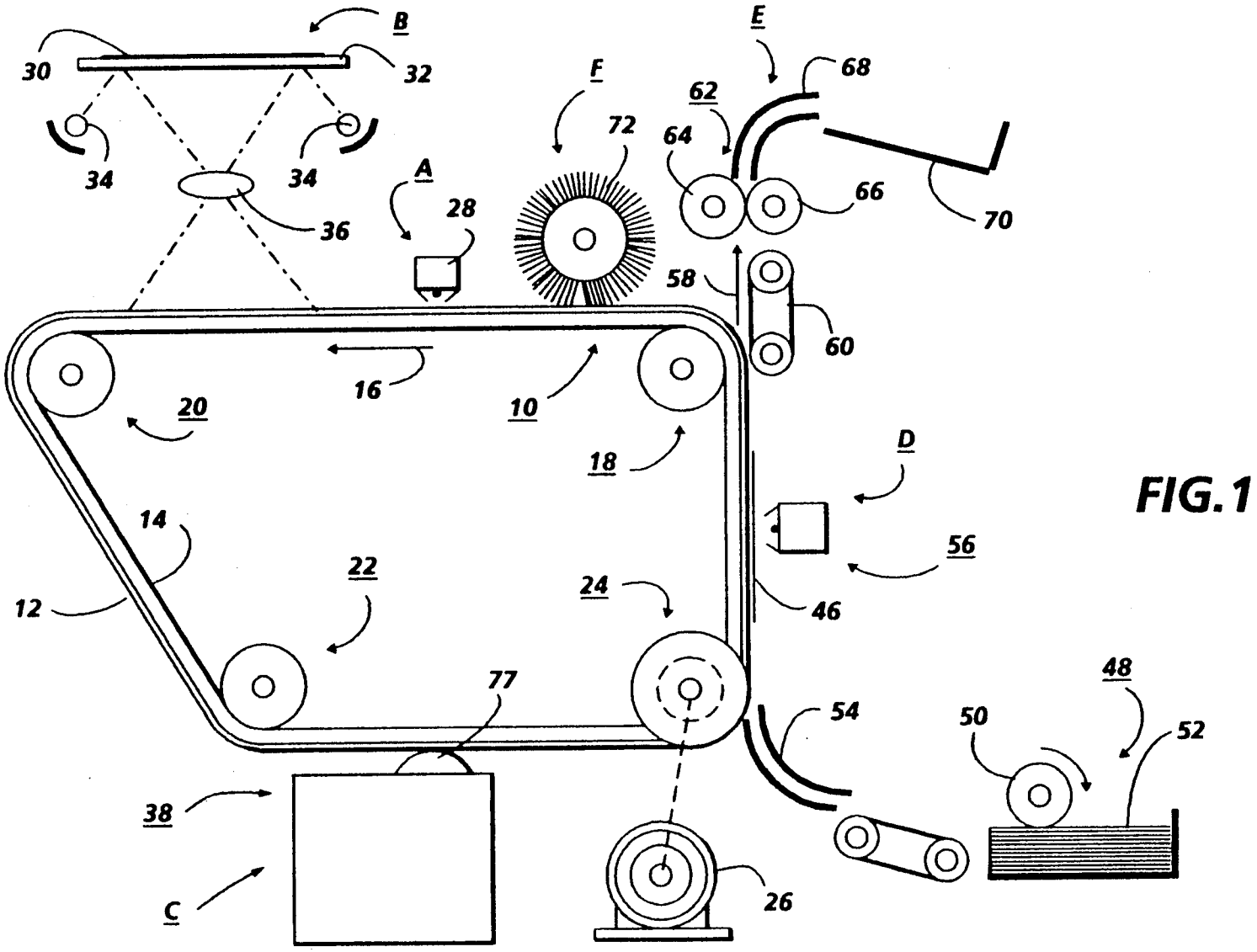
FIG. 1 is a schematic elevational view depicting an electrophotographic printing machine incorporating the development apparatus of the present invention.

For a general understanding of the features of the present invention, reference is made to the drawings. In the drawings, like reference numerals have been used throughout to designate identical elements.

FIG. 1 schematically depicts the various elements of an illustrative electrophotographic printing machine incorporating the development system and particle transport of the present invention therein. It will become evident from the the following discussion that the present invention is equally well suited for use in a wide variety of electrostatographic printing machines and other types of devices wherein granular particles are transported from an entrance port to a discharge region and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

The electrophotographic printing machine depicted in FIG. 1 includes a belt 10 having a photoconductive surface 12 deposited on a conductive substrate 14. The photoconductive surface 12 may be fabricated from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B which as disclosed herein comprises a light lens input arrangement but could also comprise an electronic input such as a raster output scanner. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Alternatively, latent image could be formed using a laser. Thereafter, belt 10 advances the electrostatic latent image recorded on photoconductive surface 12 to development station C.

Figure 2:
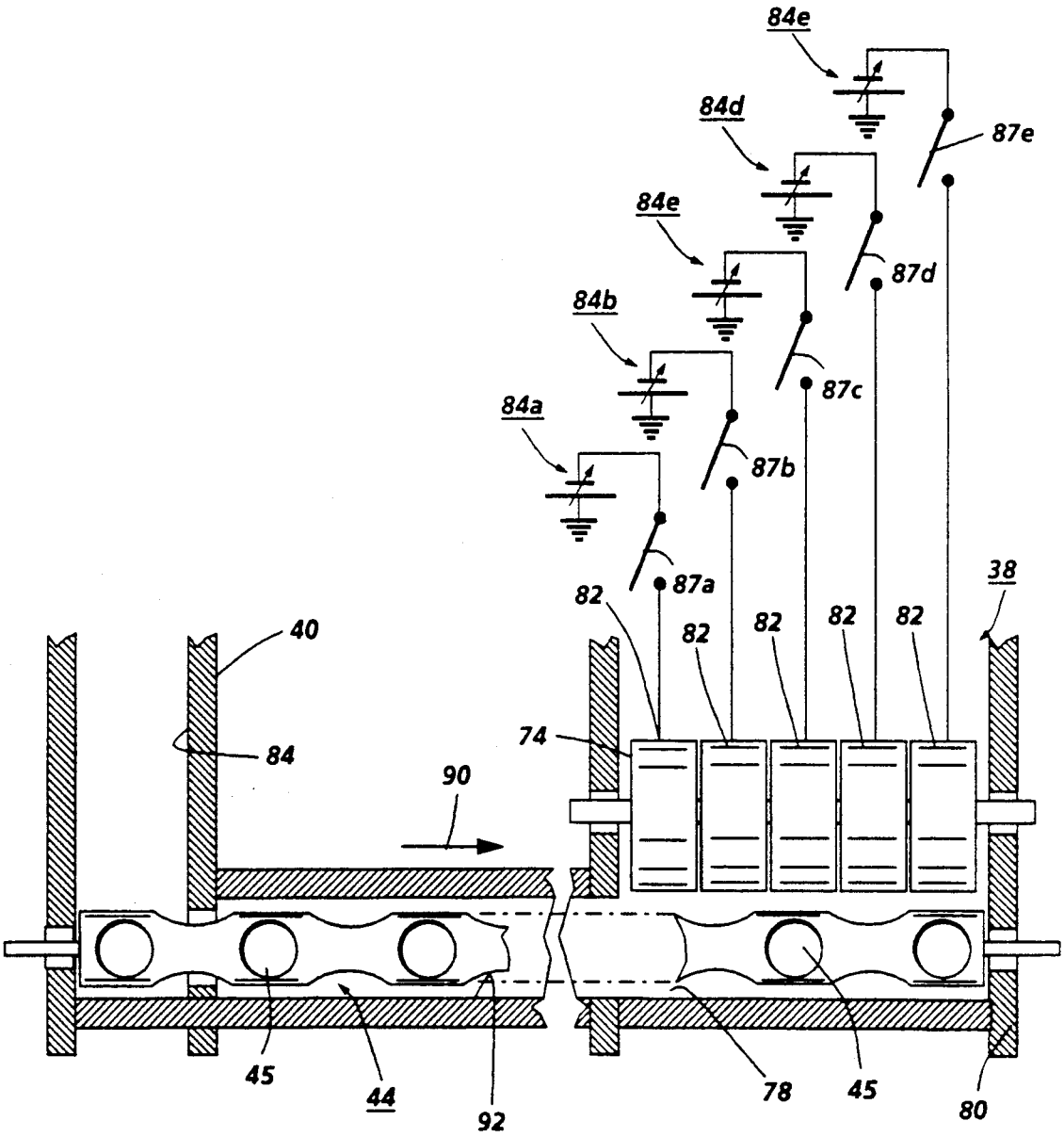
FIG. 2 is a fragmentary, sectional elevational view depicting a transport for moving toner particles from a remote toner container to a donor roll.

At development station C, a magnetic brush development system, indicated generally by the reference numeral 38, transports a two-component developer material comprising toner particles and carrier granules into contact with the electrostatic latent image recorded on photoconductive surface 12. Toner particles are furnished to development system 38 from a remote toner container 40 (FIG. 2). Particle transport 44 herein disclosed as a "holey" tube containing holes or apertures 45 couples remote toner container 40 to the housing of development unit 38 and toner particles are advanced by particle transport 44 from remote container 40 to the housing of developer unit 38. The detailed structure of developer unit 38 will be described hereinafter with reference to FIGS. 2 and 3. Developer unit 38 forms a brush of developer particles which is advanced into contact with the electrostatic latent image recorded on photoconductive surface 12 of belt 10. Toner particles are attracted to the electrostatic latent image forming a toner powder image on photoconductive surface 12 of belt 10 so as to render the electrostatic latent image visible.

The "holey" tube 44 is described in U.S. patent application Ser. No. 06/895,543 filed in the name of Jan Bares on Aug. 11, 1986 and assigned to the same assignee as the instant application.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Sheet feeding apparatus 48 may include a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Figure 3:
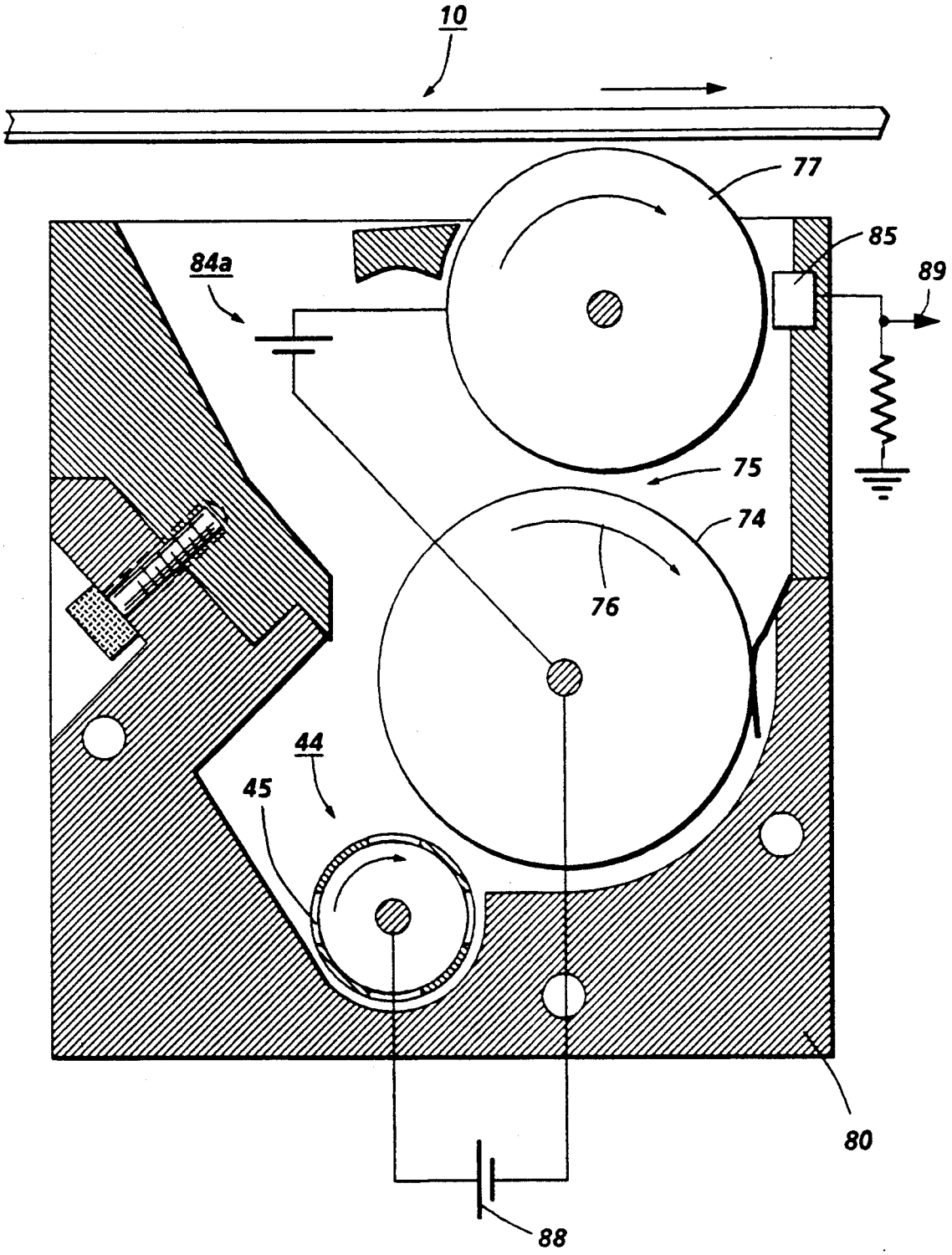
FIG. 3 is a schematic elevational view showing the development apparatus used in the FIG. 1 printing machine.

With reference to FIGS. 2 and 3, the detailed structure of developer unit 38 will now be described. The developer unit includes a toner delivery roller structure 74. Toner delivery roller structure 74 may be a bare metal such as aluminum. Alternatively, the donor roller may be a metal roller coated with a layer of insulative material. By way of example, a polytetrafluoroethylene based resin such as Teflon S, a trademark of the DuPont Corporation, or a polyvinylidene fluoride based resin, such as Kynar, a trademark of the Pennwalt Corporation, may be used to coat the metal roller. This coating acts to assist in adhering particles electrostatically to the surface thereof. Still another type of donor roller may be made from stainless steel plated by a catalytic nickel generation process and impregnated with Teflon. The surface of the roller is roughened from a fraction of a micron to several microns, peak to peak. An electrical bias can be applied to the donor roller. Roller 74 is coupled to a motor (not shown) which rotates roller 74 in the direction of arrow 76. Roller 74 is positioned, at least partially, in chamber 78 of housing 80.

The "holey" tube particle transport 44 has the exit portion thereof in chamber 78 of housing 80 so as to advance toner particles thereto. In this way, housing 78 contains a continuous supply of toner particles which can be transported by the roller 74 to a nip 75 formed between a magnetic brush roll 77 and the roller 74 from which toner can be selectively scavenged from the donor roller and swept into the developer stream of toner-depleted carrier granules or beads.

The roller 74 comprises a plurality of individual rotatably supported segments 82 which are provided with DC electrical biases 84*a* through 84*e*. The magnitude of the electrical biases 84*a* through 84*e* is in the order of 0 to 1000 volts. The electrical biases 84*a* through 84*e* can be selectively applied to their corresponding donor roller segments via normally open switches 87*a* through 87*e*. When a particular switch is actuated the electrostatic field established between that donor roller segment the magnetic brush roll 77 causes toner particles to be transferred from the former to the latter. Likewise, a DC electrical bias 88 applied between the donor roller segments and particle transport (FIG. 3) establishes an electrostatic field therebetween which effects toner deposition onto the donor roller 74.

A plurality of current flow sensors 85 (only one being shown) are positioned adjacent the magnetic brush 77 to monitor local toner concentration. Output signals derived as the result of the sensor current flow reaching a threshold level are utilized to control actuation of the switches 87*a* through 86*e* and the magnitude of the biases 84*a* through 84*e* in accordance with the condition of the developer adjacent a particular sensor. As will be appreciated, the current measured by the sensor could also be employed to effect variable biasing of the donor roller segments. The signals generated by the sensors are outputted along lines 89, only one being shown.

With particular reference to FIG. 2, toner particle transport tube 44 can be seen in greater detail. As depicted therein, particle transport 44 connects the remote toner container 40 to chamber 78 of housing 80 of developer unit 38. Toner particles stored in chamber 84 of remote container 40 are advanced by particle transport tube 44 in the direction of arrow 90 to chamber 78 of housing 80. Particle transport tube 44 is disposed in elongated duct 92 which is preferably tubular in shape, which has an entrance region in chamber 84 and an exit region in chamber 78. Particle transport tube 44 rotates and fluidizes the toner particles in duct 92. Particle transport tube 44 is adapted to fluidize and agitate the particles and imparts longitudinal movement thereto. The toner particles move in the direction of arrow 90 due to the pressure differential between chamber 78 and chamber 84. One skilled in the art will appreciate that gravity may be used to move the fluidized particles as long as the the toner level in chamber 78 is lower than that of chamber 84. In this way, the fluidized and agitated toner particles move from the entrance region of duct 44 in chamber 84 of remote container 40 to the exit region thereof in chamber 78 of housing 80. Thus, a continuous supply of toner particles is furnished from remote container 40 to housing 80 of developer unit 38. Elongated member 44 extends under or along delivery roller 74 to facilitate the deposition of toner particles on roller 74.

While the present invention has been disclosed in connection with replenishing toner depleted from a magnetic brush in accordance with the amount of toner depleted during an image development interval the invention can be utilized to inhibit toner deposition on the magnetic brush in an outboard area thereof in accordance with the size of copy paper being used. In other words when longer copy sheets are used a greater length of the magnetic brush requires developer material. In contrast when short sheets are used developer need is not required along a certain length of the longitudinal axis of the brush. In the latter case the biases on the donor roll segments opposite those portions of the magnetic brush are applied to prevent toner addition to the chamber. This aspect of the invention can be effected either through a user interface on the machine control panel or by suitable switches associated with the paper trays.

As will be appreciated, a photoreceptor drum may be employed in lieu of the belt 10. Also, while the development housing 80 is illustrated as being positioned beneath the belt 10 it may occupy other positions. For example, when used in connection with a photoreceptor drum it could occupy the 3 o'clock position.

What is claimed is:

1. Developer apparatus for use in rendering latent electrostatic images visible on an image receiving surface, said apparatus comprising:

a supply of toner;

a developer member supported remotely from said supply of toner;

means for conveying toner from said supply for deposition on said developer member;

a toner feed roll structure supported adjacent said developer member in the path of movement of said toner being conveyed from said supply of toner; and means for effecting transfer of toner from said toner feed roll structure to said developer member only in those areas thereof where toner has been depleted during a development interval.

2. Apparatus according to claim 1 wherein said toner feed roll structure comprises a plurality of individual segments.

3. Apparatus according to claim 1 wherein said means for effecting toner transfer comprises means for selectively establishing electrostatic fields between said individual segments and said developer member.

4. Apparatus according to claim 3 wherein said field establishing means comprises means for applying an electrical bias to each of each of said segments of said toner feed roll structure.

5. Apparatus according to claim 4 wherein the application of said electrical bias applied to each of said toner feed roll segments is responsive to electrical signals representing toner depleted from said developer member in areas thereof adjacent segments of said toner feed roll structure.

6. Apparatus according to claim 5 wherein said biases are variable in accordance with the amount of toner depleted from a specific area of said developer member.

7. Apparatus according to claim 1 including means for sensing the toner concentration at discrete locations along the length of said developer member for generating signals representing low toner conditions thereat and means for establishing electrostatic fields between said developer member and said toner feed roll structure in response to said low toner conditions.

8. Apparatus according to claim 7 wherein said developer member comprises a magnetic brush.

9. Apparatus according to claim 8 including a quantity of carrier particles attracted to said magnetic brush for transporting toner particles to the images on said image receiving surface.

10. In the method of rendering latent electrostatic images visible on an image receiving surface, said method comprising:

providing a supply of toner;

supporting a developer member remotely from said supply of toner;

conveying toner from said supply for deposition on said developer member;

positioning a donor roll structure adjacent said developer member and in the path of movement of said toner being conveyed from said supply of toner; and effecting transfer of toner from said donor roll structure to said developer member only in those areas thereof where toner has been depleted during development.

11. The method according to claim 10 wherein said donor roll structure comprises a plurality of individual segments.

12. The method according to claim 11 wherein said step of toner transfer selectively establishes electrostatic fields between said individual segments and said developer member.

13. The method according to claim 12 wherein said field establishing means comprises means for applying an electrical bias to each of said segments of said donor roll structure.

14. The method according to claim 13 wherein the application of said electrical biases applied to each of said donor roll segments is responsive to electrical signals representing toner depleted from said developer member in areas thereof adjacent segments of said donor roll.

15. The method according to claim 14 wherein said biases are variable in accordance with the amount of toner depleted from a specific area of said developer member.

16. The method according to claim 10 including means for sensing the toner concentration at discrete locations along the length of said developer member for generating signals representing low toner conditions thereat and means for establishing electrostatic fields between said developer member and said donor roll structure in response to said low toner conditions.

17. The method according to claim 16 wherein said developer member comprises a magnetic brush.

18. The method according to claim 17 including a quantity of carrier particles attracted to said magnetic brush for transporting toner particles to the images on said image receiving surface.

* * * * *